US010453581B2

(12) United States Patent
Ishibashi et al.

(10) Patent No.: US 10,453,581 B2
(45) Date of Patent: Oct. 22, 2019

(54) METHOD FOR MANUFACTURING ELECTRIC WIRE

(71) Applicant: YAZAKI CORPORATION, Tokyo (JP)

(72) Inventors: Kenichi Ishibashi, Shizuoka (JP); Kazumi Mochizuki, Shizuoka (JP); Yasunobu Kondo, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/700,963

(22) Filed: Sep. 11, 2017

(65) Prior Publication Data

US 2017/0372811 A1 Dec. 28, 2017

Related U.S. Application Data

(63) Continuation of application No. 13/867,275, filed on Apr. 22, 2013, now abandoned, and a continuation of (Continued)

(30) Foreign Application Priority Data

Oct. 25, 2010 (JP) ..... 2010-238196

(51) Int. Cl.
*H01B 1/02* (2006.01)
*C22C 21/00* (2006.01)

(Continued)

(52) U.S. Cl.
CPC ..... *H01B 1/023* (2013.01); *C22C 21/00* (2013.01); *C22F 1/04* (2013.01); *H01B 7/0009* (2013.01)

(58) Field of Classification Search
CPC ..... H01B 1/023; H01B 7/0009; C22F 1/04; B21C 1/00
See application file for complete search history.

(56) References Cited

U.S. PATENT DOCUMENTS 7,544,886 B2 * 6/2009 Detian ..... C22F 1/08 174/110 R
7,550,675 B2 * 6/2009 Susai ..... C22C 21/00 174/110 R (Continued)

FOREIGN PATENT DOCUMENTS

CN 101069245 A 11/2007
CN 101128887 A 2/2008

(Continued)

OTHER PUBLICATIONS

Indian Office Action for the related Indian Patent Application No. 3171/CHENP/2013 dated Dec. 26, 2017.

(Continued)

*Primary Examiner* — Peter Dungba Vo
*Assistant Examiner* — Jeffrey T Carley
(74) *Attorney, Agent, or Firm* — Kenealy Vaidya LLP

(57) ABSTRACT

A method of manufacturing an electric wire includes providing wire rods made of aluminum alloy, forming aluminum alloy wires by drawing the wire rods to a final wire diameter without heat treatment, and forming a conductor by twisting together the aluminum alloy wires with a twist pitch of 7 to 36 times a predetermined diameter of the conductor. A composition of the aluminum alloy contains 0.1 to less than 1.0% by weight of Fe, 0 to 0.08% by weight of Zr, 0.02 to 2.8% by weight of Si, and 0.05 to 0.63% by weight of Cu and/or 0.03 to 0.45% by weight of Mg, with the remainder being Al and unavoidable impurities.

12 Claims, 5 Drawing Sheets

Related U.S. Application Data application No. PCT/JP2011/075018, filed on Oct. 25, 2011.

(51) Int. Cl.
*C22F 1/04* (2006.01)
*H01B 7/00* (2006.01)

(56) References Cited

U.S. PATENT DOCUMENTS

| | | | | |
|---|---|---|---|---|
| 9,147,504 | B2 * | 9/2015 | Kusakari | B21C 1/00 |
| 2003/0111256 | A1 * | 6/2003 | Fujiwara | H01B 1/023 174/128.1 |
| 2008/0196923 | A1 * | 8/2008 | Susai | C22C 21/00 174/110 R |
| 2011/0036614 | A1 * | 2/2011 | Otsuka | C22C 21/00 174/113 R |
| 2011/0132659 | A1 * | 6/2011 | Kusakari | B21C 1/00 174/72 A |
| 2011/0140517 | A1 * | 6/2011 | Kusakari | B21C 1/00 307/9.1 |
| 2013/0126231 | A1 * | 5/2013 | Kusakari | B21C 1/00 174/72 A |
| 2013/0255840 | A1 * | 10/2013 | Otsuka | C22C 21/00 148/523 |
| 2015/0357072 | A1 * | 12/2015 | Kusakari | B21C 1/00 174/110 R |

FOREIGN PATENT DOCUMENTS

| | | | |
|---|---|---|---|
| CN | 101828240 | A | 9/2010 |
| DE | 19744667 | A1 | 4/1998 |
| EP | 1852875 | A1 | 11/2007 |
| GB | 1 263 495 | A | 2/1972 |
| JP | 46-56756 | | 3/1973 |
| JP | 49-78616 | | 7/1974 |
| JP | S59-222550 | A | 12/1984 |
| JP | 60-154407 | A | 8/1985 |
| JP | 62-262315 | A | 11/1987 |
| JP | 08-277447 | A | 10/1996 |
| JP | 2000-251529 | A | 9/2000 |
| JP | 2004-134212 | A | 4/2004 |
| JP | 2006-12468 | A | 1/2006 |
| JP | 2006-19164 | A | 1/2006 |
| JP | 2006-253109 | A | 9/2006 |
| JP | 2008-218273 | A | 9/2008 |
| JP | 2008-277195 | A | 11/2008 |
| WO | 2010/018646 | A1 | 2/2010 |
| WO | WO2010/082671 | A1 | 7/2010 |
| WO | WO2011/004814 | A1 | 1/2011 |

OTHER PUBLICATIONS

International Search Report and Written Opinion of the International Search Report for PCT/JP2011/075018 dated Dec. 28, 2011.
Chinese Office Action for the related Chinese Patent Application No. 201180051702.7 dated Nov. 4, 2014.
Japanese Office Action for the related Japanese Patent Application No. 2010-238196 dated Nov. 25, 2014.
Chinese Office Action for the related Chinese Patent Application No. 201180051702.7 dated Jun. 16, 2015.
Japanese Office Action for the related Japanese Patent Application No. 2010-238196 dated Jul. 14, 2015.
Japanese Office Action for the related Japanese Patent Application No. 2010-238196 dated Sep. 13, 2016.

* cited by examiner

METHOD FOR MANUFACTURING ELECTRIC WIRE

CROSS REFERENCE TO RELATED APPLICATIONS

This application is a continuation of U.S. patent application Ser. No. 13/867,275 filed on Apr. 22, 2013, which is a continuation of PCT application No. PCT/JP2011/075018 filed on Oct. 25, 2011 claiming priority from Japanese Patent Application No. 2010-238196 filed on Oct. 25, 2010, the contents of which are incorporated herein by reference.

BACKGROUND OF THE INVENTION

Technical Field

The present invention relates to an electric wire or cable including a conductor obtained by twisting together aluminum alloy wires.

Background Art

Copper has hitherto been mainly used as a conductor material of electric wires used in automotive wire harnesses and the like. Copper is excellent in terms of tensile strength and electric conductivity as the material, but has a problem of heavy weight (density). Accordingly, with a recent demand for weight reduction, a trend toward reconsideration of the conductor material has appeared. In such a situation, it has been particularly studied to use aluminum.

Aluminum is light in weight, but has a problem of insufficient strength. Further, aluminum also has a problem of low flexibility compared to copper. For example, in the case of low flexibility, there is a concern that it becomes unsuitable to arrange an electric wire or cable in a place where flexing thereof is repeated. Specifically, there is a concern that it becomes unsuitable to arrange the electric wire or cable around a hinge of a door or a trunk in an automobile. The reason for this is that aluminum is broken (wire disconnected) earlier than copper by the repetition of flexing.

Incidentally, in order to solve the above problems of insufficient strength and low flexibility, for example, JP-A-2004-134212 has been proposed.

SUMMARY OF THE INVENTION

As an electric wire or cable which becomes possible to be arranged in a place where flexing thereof is repeated, the present inventors consider that it is effective to adjust the twist pitch of a conductor obtained by twisting together aluminum alloy wires (conductor twist pitch) within a predetermined range. That is to say, when high twists are imparted to give strength to the conductor itself, flexibility also increases associated therewith. As a result, it becomes possible to arrange the electric wire or cable in the place where flexing thereof is repeated.

In the realization thereof, the inventors consider that it is necessary to find out a range of the conductor twist pitch which can provide good flexibility, and that it is necessary to find out such an aluminum alloy composition that twisting can be performed with a strength sufficient to induce, for example, no disconnection of the aluminum alloy wires at this conductor twist pitch.

The invention has been made in view of the circumstances described above, and an object thereof is to provide an electric wire or cable whose flexibility can be enhanced.

An electric wire or cable of the invention according to the first aspect of the invention made in order to achieve the above object includes a conductor obtained by twisting together aluminum alloy wires, wherein the conductor is formed with a conductor twist pitch of 7 to 36 times a predetermined diameter thereof, and a composition of an aluminum alloy before formation of the aluminum alloy wires contains 0.1 to less than 1.0% by weight of Fe, 0 to 0.08% by weight of Zr, 0.02 to 2.8% by weight of Si, and 0.05 to 0.63% by weight of Cu and/or 0.03 to 0.45% by weight of Mg, with the remainder being Al and unavoidable impurities.

An electric wire or cable of the invention according to the second aspect of the invention is the electric wire or cable according to the first aspect of the invention, wherein the above aluminum alloy wires are obtained by wire drawing from wire rods to a final wire diameter without heat treatment.

An electric wire or cable of the invention according to the third aspect of the invention is the electric wire or cable according to the first or second aspect of the invention, wherein the above aluminum alloy wires have a tensile strength of 80 MPa or more, an electric conductivity of 57.5% IACS or more and an elongation of 10% or more.

An electric wire or cable of the invention according to the fourth aspect of the invention is the electric wire or cable according to any one of the first to third aspect of the invention, wherein the above conductor twist pitch is adjusted to 10 to 30 times the predetermined diameter of the conductor.

According to the first aspect of the invention described above, the conductor is formed by twisting together the aluminum alloy wires. Further, the conductor is formed with a conductor twist pitch of 7 to 36 times the predetermined diameter of the conductor. In the conductor, the composition of the aluminum alloy before formation of the aluminum alloy wires contains Fe, Zr, Si and at least one of Cu and Mg, and further, the remainder is Al and unavoidable impurities. Aluminum is used as a base material in the conductor, so that the lightweight electric wire or cable is obtained.

In the invention according to the second aspect of the invention, the conductor twist pitch is limited to 7 times or more, because there is a concern that twist float occurs in the twisting step, and further, there is a concern that the wires overlap each other in the twisting step to result in a failure to twist together the wires with constant pitches. On the other hand, the conductor twist pitch is limited to 36 times or less, because there is a concern that the number of flexing cycles used for judging whether flexibility is good or poor is less than the desired number.

In the invention according to the first aspect of the invention, the Fe content in the composition of the aluminum alloy is limited to the range of 0.1 to less than 1.0% by weight, because in the case of less than 0.1% by weight, it becomes impossible to expect improvement of tensile strength, and flexibility is also influenced, whereas in the case of 1.0% by weight or more, it becomes difficult to secure electric conductivity. The Zr content is limited to the range of 0 to 0.08% by weight, because in the case of 0% by weight, heat resistance is improved by allowing Mg to be contained in an amount of 0.03 to 0.45% by weight as an alternative element, whereas in the case of exceeding 0.08% by weight, it becomes difficult to secure electric conductivity. The Si content is limited to the range of 0.02 to 2.8% by weight, because in the case of less than 0.02% by weight, it becomes impossible to expect improvement of tensile strength, and flexibility is also influenced, whereas in the case of exceeding 2.8% by weight, it becomes difficult to secure electric conductivity. The Cu content is limited to the range of 0.05 to 0.63% by weight, because in the case of less than 0.05% by weight, it becomes impossible to expect improvement of tensile strength, and flexibility is also influenced, whereas in the case of exceeding 0.63% by weight, it becomes difficult to secure electric conductivity. The Mg content is limited to the range of 0.03 to 0.45% by weight, because in the case of less than 0.03% by weight, it becomes impossible to expect improvement of tensile strength, and flexibility is also influenced, whereas in the case of exceeding 0.45% by weight, it becomes difficult to secure electric conductivity. The reason for containing Cu and/or Mg in the composition is that they have an effect of solid solution strengthening to Al. When Cu and Mg are both contained, the total amount of both is preferably from 0.04 to 0.6% by weight, and more preferably from 0.1 to 0.4% by weight.

In the invention according to the first aspect of the invention, the conductor may be either a compacted conductor or a non-compacted conductor.

According to the invention according to the second aspect of the invention described above, the wire drawing is performed from the wire rods to the final wire diameter without the heat treatment, because it is effective for inhibiting a decrease in electric conductivity or elongation. That is to say, when the heat treatment is conducted before the wire drawing, work hardening occurs by the subsequent wire drawing, whereby the aluminum alloy wires are liable to become hard to cause a decrease in electric conductivity or elongation. In order to inhibit this, it is effective to perform the wire drawing from the wire rods to the final wire diameter without the heat treatment.

According to the invention according to the third aspect of the invention described above, as properties of the aluminum alloy wires, the tensile strength is 80 MPa or more, because in the case of less than 80 MPa, the aluminum alloy wires are too weak for handling and the like, so that there is a concern that it becomes difficult to use them as the conductor. It is not that the higher the tensile strength, the better it is, and the elongation tends to decrease with an increase in tensile strength. It is therefore effective to adjust the elongation to 10% or more. Further, the electric conductivity is 57.5% IACS or more, because the use thereof as an electric power line is made possible, and high electric conductivity is secured as the aluminum alloy wires.

Incidentally, the above term "% IACS" means the electric conductivity in the case where a resistivity of $1.7241\times10^{-8}$ Ω based on the International Annealed Copper Standard is taken as 100% IACS. Pure aluminum has an electric conductivity of about 66% IACS.

According to the invention according to the fourth aspect of the invention described above, the conductor twist pitch is adjusted preferably to 10 to 30 times the predetermined diameter of the conductor.

According to the invention according to the first aspect of the invention, there is exhibited an effect that flexibility can be more increased than conventional, from both sides of the conductor twist pitch and the composition. Thereby, there is an effect that the electric wire or cable can be arranged in the place where flexing thereof is repeated.

According to the invention according to the second aspect of the invention, there is exhibited an effect that a decrease in electric conductivity or elongation can be inhibited without hardening the aluminum alloy wires more than necessary.

According to the invention according to the third or fourth aspect of the invention, there is exhibited an effect that the electric wire or cable in which consideration is more given to its use can be provided.

DETAILED DESCRIPTION OF THE EXEMPLARY EMBODIMENTS

Figure 1:
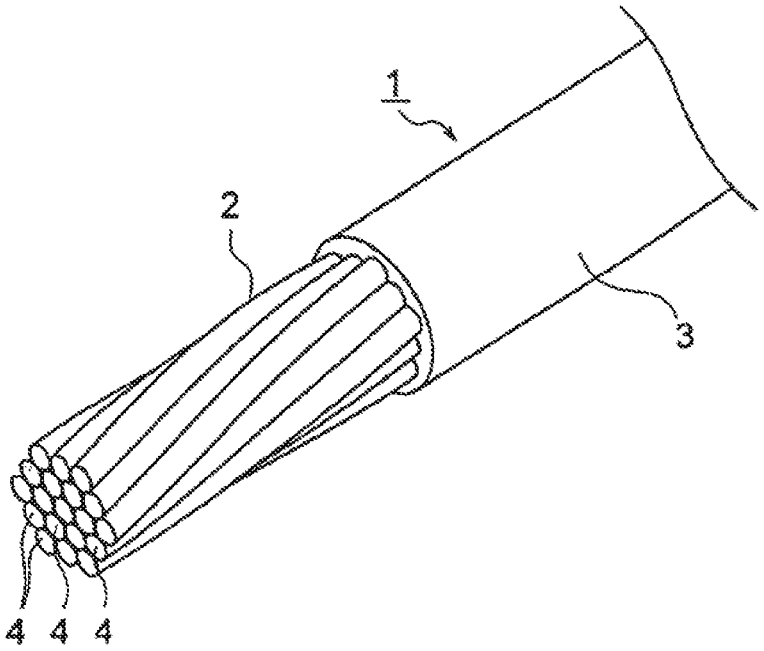
FIG. 1 is a perspective view showing an electric wire as one embodiment of an electric wire or cable of the invention.
Figure 2:
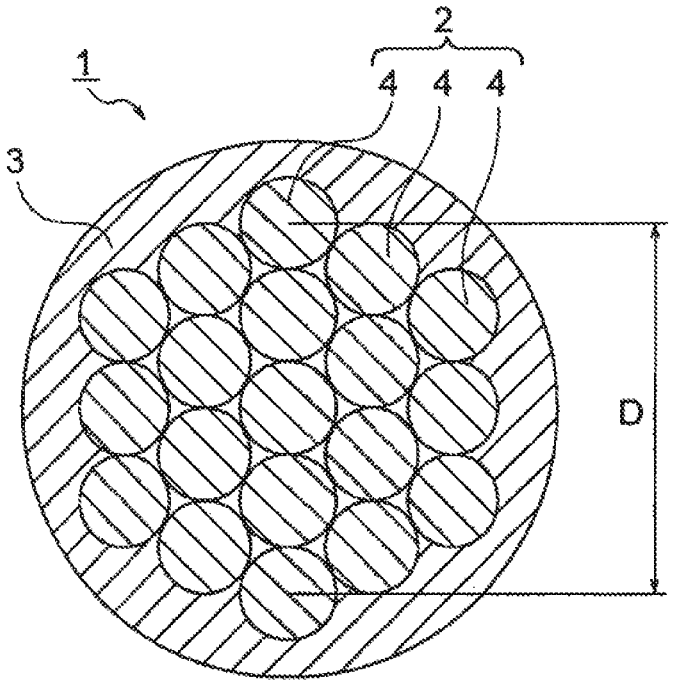
FIG. 2 is a cross-sectional view of the electric wire of FIG. 1.
Figure 3:
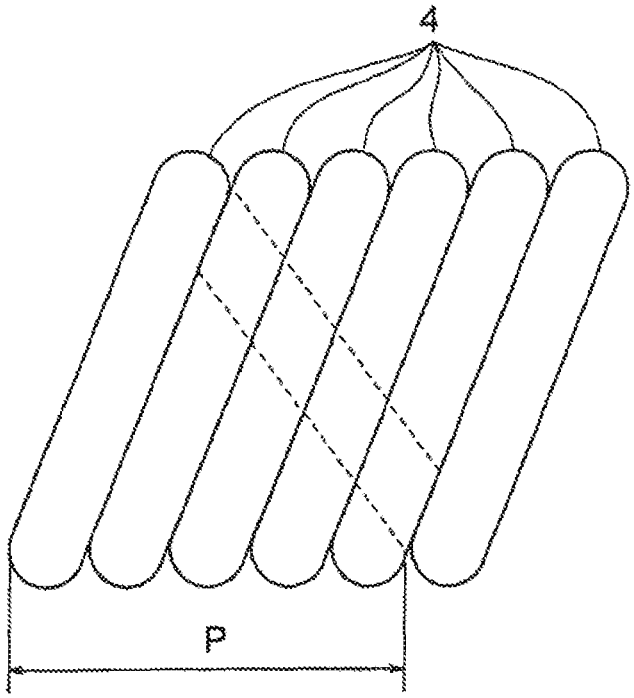
FIG. 3 is a view for illustrating a conductor twist pitch.

Two embodiments of the invention will be described below with reference to the drawings. FIG. 1 is a perspective view showing an electric wire as one embodiment of an electric wire or cable of the invention, FIG. 2 is a cross-sectional view of the electric wire of FIG. 1, and FIG. 3 is a view for illustrating a conductor twist pitch. Further, FIG. 4 is a perspective view showing an electric wire as another embodiment of an electric wire or cable of the invention, and FIG. 5 is a cross-sectional view of the electric wire of FIG. 4.

In FIG. 1 and FIG. 2, an electric wire 1 includes a conductor 2 (core wire) having electric conductivity and an insulating insulator 3 (coating) which covers the conductor 2. The conductor 2 is a twisted wire conductor and a non-compact conductor, and is formed by twisting together plural aluminum alloy wires 4. As shown in FIG. 2, the conductor 2 has a layer core diameter D (predetermined diameter) which is a distance between centers of the aluminum alloy wires 4 positioned at an outermost layer, and is formed with a conductor twist pitch P (see FIGS. 3) of 7 to 36 times the layer core diameter D (although described later, the conductor twist pitch P is preferably from 10 to 30 times the layer core diameter). In the case of the conductor 2, the conductor twist pitch P is the length obtained by multiplying the layer core diameter D by the above multiplying factor. Incidentally, the number of the aluminum alloy wires 4 in FIGS. 1 and 2 is only shown by way of example.

Figure 4:
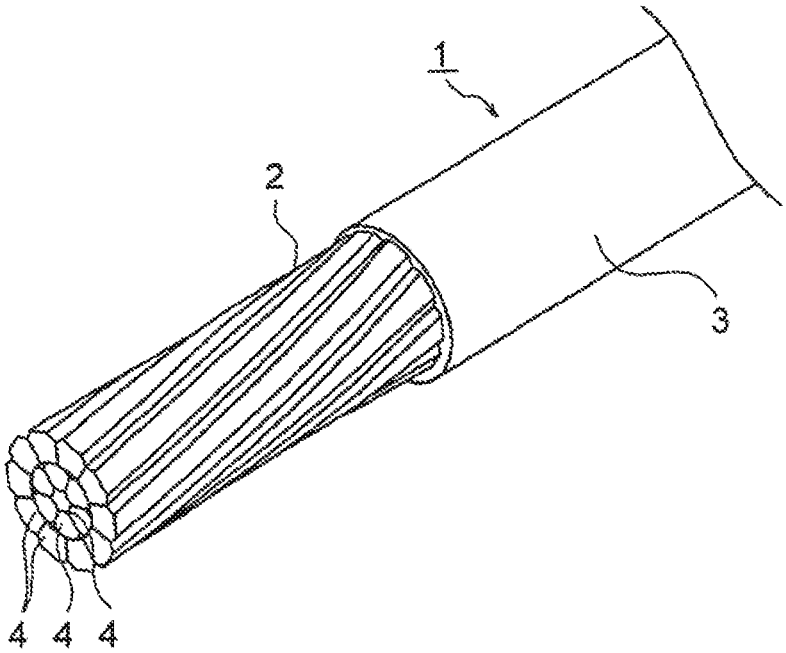
FIG. 4 is a perspective view showing an electric wire as another embodiment of an electric wire or cable of the invention.
Figure 5:
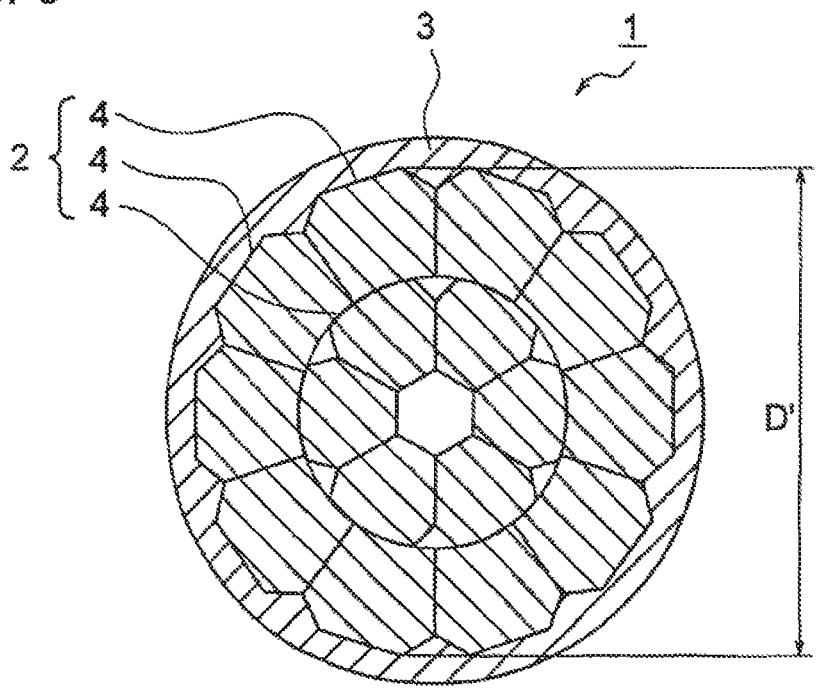
FIG. 5 is a cross-sectional view of the electric wire of FIG. 4.

In FIGS. 4 and 5, an electric wire 1 includes a conductor 2 (core wire) having electric conductivity and an insulating insulator 3 (coating) which covers the conductor 2. The conductor 2 is a twisted wire conductor, and is formed by twisting together plural aluminum alloy wires 4. Further, the conductor 2 is a compact conductor, and is formed so as to have a predetermined conductor outer diameter D' (predetermined diameter) while compressing plural aluminum alloy wires 4. Incidentally, the number of the aluminum alloy wires 4 in FIGS. 4 and 5 is only shown by way of example. The conductor 2 is formed with a conductor twist pitch P (see FIGS. 3) of 7 to 36 times the conductor outer diameter D' (although described later, the conductor twist pitch P is preferably from 10 to 30 times the conductor outer diameter). The conductor outer diameter D' is an outermost diameter of the conductor 2, and the length obtained by multiplying such a conductor outer diameter D' by the above multiplying factor is the conductor twist pitch P.

When the above multiplying factor is low, the conductor twist pitch P becomes short, whereas when the multiplying factor is high, the conductor twist pitch P becomes long. The smaller the conductor twist pitch P becomes, the higher the plural aluminum alloy wires 4 are twisted together, thereby being able to give strength to the conductor 2 itself (however, not too hard). When the strength is given to the conductor 2 itself, the flexibility is also enhanced thereby.

The aluminum alloy wires 4 are formed with such a composition that twisting can be performed with a strength sufficient to induce, for example, no disconnection or the like at the above conductor twist pitch P. Specifically, the aluminum alloy (not shown) before formation of the aluminum alloy wires 4 contains Fe, Zr and Si. Further, the above aluminum alloy contains at least one of Cu and Mg, and further, the remainder is Al and unavoidable impurities. The above composition will be described below.

The aluminum alloy includes Al acting as a base material, namely a virgin aluminum ingot, and predetermined elements added thereto. As the aluminum base metal, there is preferably used pure aluminum having a purity of 99.70%. That is to say, of the pure virgin aluminum ingots specified in JIS H 2102, one having a purity of a type 1 or higher virgin aluminum ingot is suitable. Here, the type 1 virgin aluminum ingot has a purity of 99.70% or more, the special type 2 virgin aluminum ingot has a purity of 99.85% or more, and the special type 1 virgin aluminum ingot has a purity of 99.90% or more. Incidentally, in the invention, there can be used not only high-purity and expensive virgin aluminum ingots such as the special type 1 and the special type 2, but also the type 1 virgin aluminum ingot which is reasonable in price. It goes without saying that the cost can be reduced thereby.

The elements added to the above virgin aluminum ingot are Fe, Zr, Si and Cu and/or Mg. Of these elements, Fe is an element having a low solid solubility limit, and a deposit crystallized as an intermetallic compound causes a strengthening mechanism. Fe is contained in the aluminum alloy in an amount of 0.1 to less than 1.0% by weight. The reason why the Fe content is limited to the range of 0.1 to less than 1.0% by weight is that in the case of less than 0.1% by weight, it becomes impossible to expect improvement of tensile strength, thereby also affecting flexibility, whereas in the case of 1.0% by weight or more, it becomes difficult to secure electric conductivity. It is more preferred that Fe is allowed to be contained in an amount of 0.4 to 0.9% by weight.

Zr is an element which can secure an equivalent tensile strength in an amount (content) smaller than that of Si. Further, Zr is an element which is effective for improvement of heat resistance, as is the case with Mg, and can improve strength by solid solution strengthening. In order to preferably obtain this effect, Zr is contained in the aluminum alloy in an amount of 0 to 0.08% by weight. The reason why the Zr content is limited to the range of 0 to 0.08% by weight is that in the case of 0% by weight, heat resistance is improved by allowing Mg to be contained in an amount of 0.03 to 0.45% by weight as an alternative element, whereas in the case of exceeding 0.08% by weight, it becomes difficult to secure electric conductivity. Zr is allowed to be contained preferably in an amount of 0.02 to 0.08% by weight, and more preferably in an amount of 0.02 to 0.05% by weight.

Si is an element which is effective for improvement of strength. Si is contained in the aluminum alloy in an amount of 0.02 to 2.8% by weight. The reason why the Si content is limited to the range of 0.02 to 2.8% by weight is that in the case of less than 0.02% by weight, it becomes impossible to expect improvement of tensile strength, thereby affecting flexibility, whereas in the case of exceeding 2.8% by weight, it becomes difficult to secure electric conductivity. Si is allowed to be contained preferably in an amount of 0.02 to 1.8% by weight, and more preferably in an amount of 0.02 to 0.25% by weight.

Cu is an element having an effect of solid solution strengthening to Al. That is to say, Cu is an element which can improve strength by solid solution strengthening. Cu is contained in the aluminum alloy in an amount of 0.05 to 0.63% by weight. The reason why the Cu content is limited to the range of 0.05 to 0.63% by weight is that in the case of less than 0.05% by weight, it becomes impossible to expect improvement of tensile strength, thereby affecting flexibility, whereas in the case of exceeding 0.63% by weight, it becomes difficult to secure electric conductivity.

Mg is an element having an effect of solid solution strengthening to Al, as is the case with Cu. That is to say, Mg is an element which can improve strength by solid solution strengthening. Mg is contained in the aluminum alloy in an amount of 0.03 to 0.45% by weight. The reason why the Mg content is limited to the range of 0.03 to 0.45% by weight is that in the case of less than 0.03% by weight, it becomes impossible to expect improvement of tensile strength, thereby affecting flexibility, whereas in the case of exceeding 0.45% by weight, it becomes difficult to secure electric conductivity.

When Cu and Mg are both contained, the total amount of both contained in the aluminum alloy is preferably from 0.04 to 0.6% by weight, and more preferably from 0.1 to 0.4% by weight.

The aluminum alloy wires 4 are formed by producing wire rods by a conventional method and subjecting the wire rods to wire drawing. In the wire drawing, heat treatment (annealing) may be properly conducted, but it is preferred to perform the wire drawing to a final wire diameter before the heat treatment to form the aluminum alloy wires 4. When the wire drawing is performed without conducting the heat treatment before or during the wire drawing, work hardening can be inhibited. Further, when the annealing is performed after the wire drawing, properties such as electric conductivity and elongation can be improved.

Preferred manufacturing methods of the aluminum alloy wires 4 include a manufacturing method including the following steps: (1) a step of forming the wire rods using the aluminum alloy having the above composition (rolling), (2) a step of subjecting the resulting wire rods to the wire drawing to the final wire diameter (reduction working), and (3) a step of continuously annealing the drawn wire rods subjected to the wire drawing. The wire drawing step (2) as used herein means reduction working and contains no heat treatment step. Accordingly, the wire drawing step (2) is performed without associated heat treatment.

According to such a manufacturing method, the wires can be manufactured by a flow of casting→rolling→wire drawing→heat treatment, when described including a casting step of the aluminum alloy. In particular, continuous annealing (not batch annealing) can be performed as the heat treatment, so that effectiveness can be extremely enhanced in two sides of time and cost, compared to steps of casting→rolling→wire drawing→heat treatment→wire drawing→heat treatment in a conventional method.

The respective steps of the above (1) to (3) can be performed by known methods. Incidentally, in addition to the above steps (1) to (3), another step such as a plane cutting step may be contained as needed. The forming step to the wire rods in the above (1) can be performed by a continuous casting-directed rolling method, an extrusion method or the like. The rolling may be either hot rolling or cold rolling. The wire drawing step of the above (2) is performed using a dry or wet wiredrawing machine (conditions are not particularly limited).

The aluminum alloy has the above composition, thereby being excellent in wire drawing workability. When the aluminum alloy is excellent in wire drawing workability, for example, wire rods having a diameter of 9.5 mm can be wire-drawn to a finished diameter of about 0.3 mm without heat treatment.

The continuous annealing step of the above (3) can be performed using a continuous annealing furnace. For example, the drawn wire rods are conveyed at a predetermined rate, allowed to pass through the heating furnace, and heated by high-frequency waves in a predetermined zone, thereby being able to to perform annealing. Incidentally, the conveying rate, the annealing time, the annealing temperature and the like are not particularly limited, and cooling conditions after the annealing are also not particularly limited.

It is preferred that the aluminum alloy wires 4 composed of the aluminum alloy having the composition as described above have a tensile strength of 80 MPa or more, an electric conductivity of 57.5% IACS or more and an elongation of 10% or more, as properties thereof. The tensile strength is 80 MPa or more, because in the case of less than 80 MPa, the aluminum alloy wires are too weak for handling and the like such as arrangement thereof in an automobile, so that there is a concern that it becomes difficult to use them. It is not that the higher the tensile strength, the better it is, and the elongation tends to decrease with an increase in tensile strength. It is therefore effective to adjust the elongation to 10% or more. Further, the electric conductivity is 57.5% IACS or more, because the use thereof as an electric power line is made possible, and high electric conductivity is secured as the aluminum alloy wires 4.

In the above aluminum alloy, unavoidable impurities might be contained. The unavoidable impurities include Zn, Ni, Mn, Pb, Cr, Ti, Sn, V, Ga, B, Na and the like. These elements are unavoidably contained within the range not impairing the effects of the invention and not exerting a particular influence on the properties of the aluminum alloy, and elements previously contained in the virgin aluminum ingot to be used are also included in the unavoidable impurities as used herein. The predetermined elements are added to the virgin aluminum ingot, and the aluminum alloy is cast according to a conventional method.

In FIGS. 1, 2, 4 and 5, the insulator 3 is formed by extrusion coating to the outside of the conductor 2. As a material of the insulator 3, PP is used herein. However, it is not limited thereto. That is to say, it is possible to use known insulator materials which can be used as wire coating materials.

A wire harness can be formed by bundling the plural electric wires 1. Further, a cable can be formed by coating the outside of the insulator 3 with a sheath. The wire harness or cable is formed by a conventional method. The wire harness or cable including the electric wires 1 can be arranged around a hinge of a door or a trunk in an automobile (applicable to various fields, not limited to the automobile).

As described above with reference to FIGS. 1 to 5, according to the invention, the flexibility can be enhanced from two sides of the conductor twist pitch P and the composition. It becomes possible thereby to arrange the wire harness or cable including the electric wires 1 in a place where flexing thereof is repeated.

EXAMPLES

The invention will be described below with reference to examples. However, the invention should not be construed as being limited to the following examples.

In Table 1 and Table 2, there are shown contents relating to the composition and flexibility of Examples 1 to 31 and Comparative Examples 1 to 12.

<Formation of Electric Wires of Examples and Comparative Examples>

Using a type 1 virgin aluminum ingot of JIS H 2102, predetermined amounts of Fe, Zr and Si are added thereto, and Cu and/or Mg are added thereto to first obtain an aluminum alloy having each of the component compositions as shown in Table 1. Then, this aluminum alloy is melted by a conventional method, and worked to wire rods having a diameter of 9.5 mm by a continuous casting-directed rolling method. Next, the wire rods are subjected to wire drawing using a wiredrawing machine to obtain drawn wire rods (thin wires) having a diameter of 0.32 mm. Then, continuous annealing is performed to the drawn wire rods to form aluminum alloy wires. Thereafter, 16 wires of the aluminum alloy wires are twisted together to form a compact conductor. Further, 19 wires of the aluminum alloy wires are twisted together to form a non-compact conductor. Twisting at this time is performed so as to give a conductor twist pitch of a desired multiplying factor to a predetermined diameter. Finally, an insulator having a predetermined thickness is provided outside the compact conductor and the non-compact conductor, thereby forming electric wires.

<Measurement and Evaluation for Composition>

For the aluminum alloy wires having a diameter of 0.32 mm formed as described above, the following measurement and evaluation are made in accordance with JIS C 3002. With respect to the electric conductivity, the specific resistance thereof is measured in a temperature controlled chamber maintained at 20° C. (±0.5° C.), using a four-terminal method, and the electric conductivity is calculated therefrom. The distance between terminals at this time is 1,000 mm The tensile strength and the elongation are measured at a tensile speed of 50 mm/min. The wire drawing workability is evaluated by an evaluation of a disconnection property. The disconnection property is evaluated by counting how many times disconnection occurs when the wire are produced from 1 ton of the wire rods. Five times/ton or less is judged as good, 6 to 9 times/ton as fair, and 10 times/ton or more as poor. Evaluation of the composition is judged from measurement and evaluation for the composition, wherein the case where the electric conductivity, tensile strength, elongation and disconnection property are equal to or higher than the standards is judged as good, and the case where they do not satisfy the standards is judged as poor.

<Measurement and Evaluation for Flexibility>

For the electric wires formed as described above, the following measurement and evaluation are made. A predetermined sample is flexed in a flexing test (described later), and the number of flexing cycles until breakage occurs is measured. The case where the number of flexing cycles is 1,000 cycles is judged as good, and the case where it is less than 1,000 is judged as poor. With respect to the overall judgment, the case where the electric conductivity, tensile strength, elongation and disconnection property are equal to or higher than the standards and the number of flexing cycles is equal to or higher than the standard is judged as good, and the case where they do not satisfy the standards is judged as poor.

Figure 6:
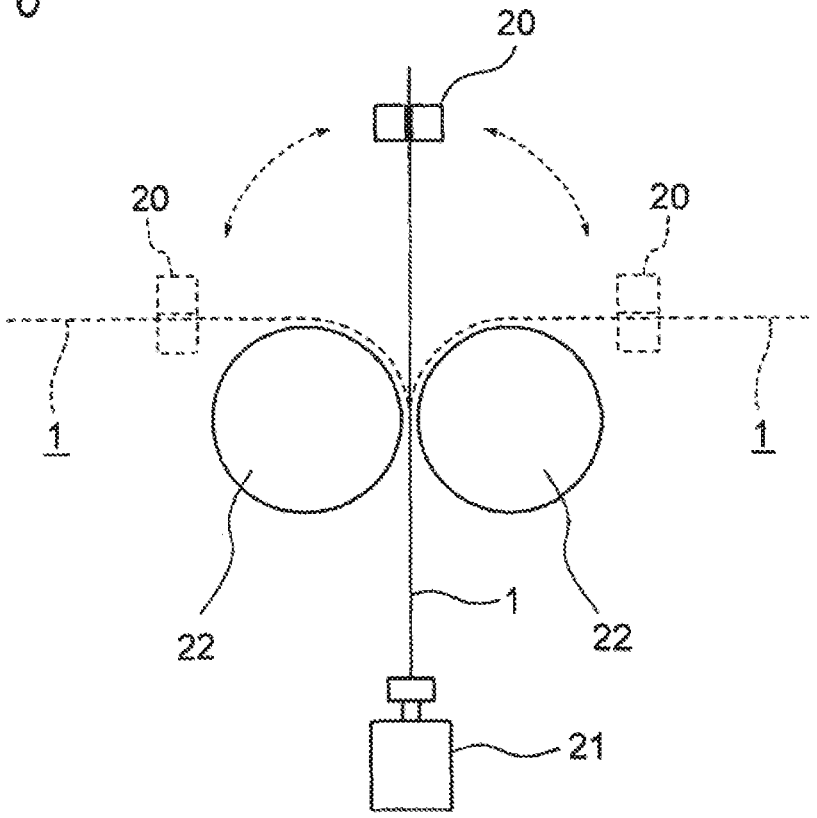
FIG. 6 is a view for illustrating a flexing test.

The above flexing test is a test performed using a jig or the like which can repeatedly flex the electric wire 1 as the sample. As a specific example, as shown in FIG. 6, one end (an upper end) of the electric wire 1 is first fixed to a jig 20, and a weight 21 is attached to the other end (a lower end) thereof. Then, the electric wire 1 is allowed to pass between two cylindrical bending jigs 22, and the jig 20 is moved thereon to the side of the one bending jig 22 to flex the one end of the electric wire 1 along a peripheral surface of the one bending jig 22. Thereafter, the jig 20 is moved to the side of the other bending jig 22 to flex the one end of the electric wire 1 along a peripheral surface of the other bending jig 22. This operation is repeated. According to the flexing test, the electric wire 1 is repeatedly flexed alternately to the opposite directions, and when the number of flexing cycles reaches 1,000 cycles thereby, it is shown that the electric wire 1 is has sufficient performance as a wire harness of an automobile.

In Table 1 and Table 2, Examples 1 to 31 and Comparative examples 1 to 12 are arranged in turn from above in a vertical direction thereof. On the other hand, in Table 1, Zr (wt %), Fe (wt %), Si (wt %), Cu (wt %), Mg (wt %), electric conductivity (% IACS), tensile strength (MPa), elongation (%), disconnection property (good, fair or poor) and composition judgment (good or poor) are arranged in turn from the left in a lateral direction thereof. Further, in table 2, kind of compact conductor or non-compact conductor, multiplying factor of twist pitch (times), number of flexing cycles (cycles), number of flexing cycles (judgment) (good or poor) and overall judgment (good or poor) are arranged in turn from the left in a lateral direction thereof.

Figure 7:
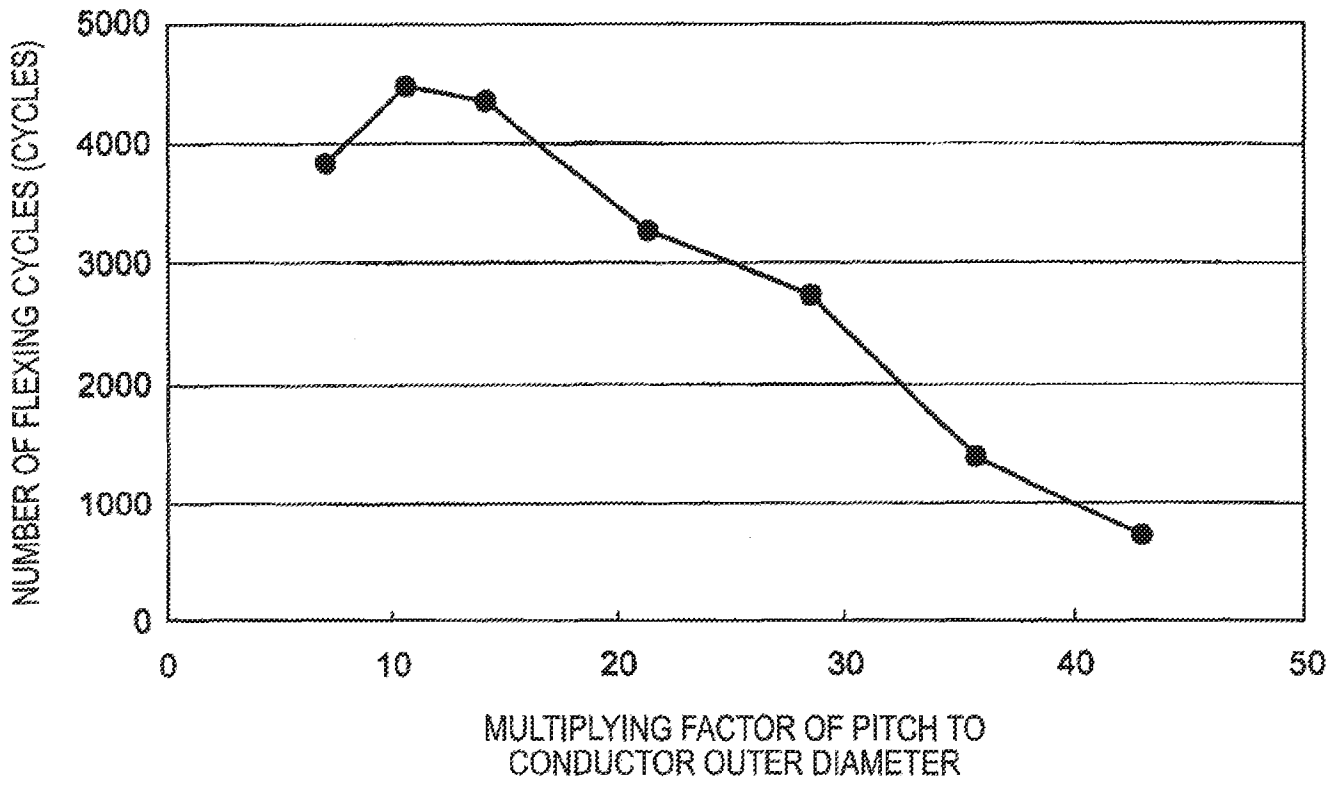
FIG. 7 is a graph for a multiplying factor of a pitch to a conductor outer diameter—a number of flexing cycle.
Figure 8:
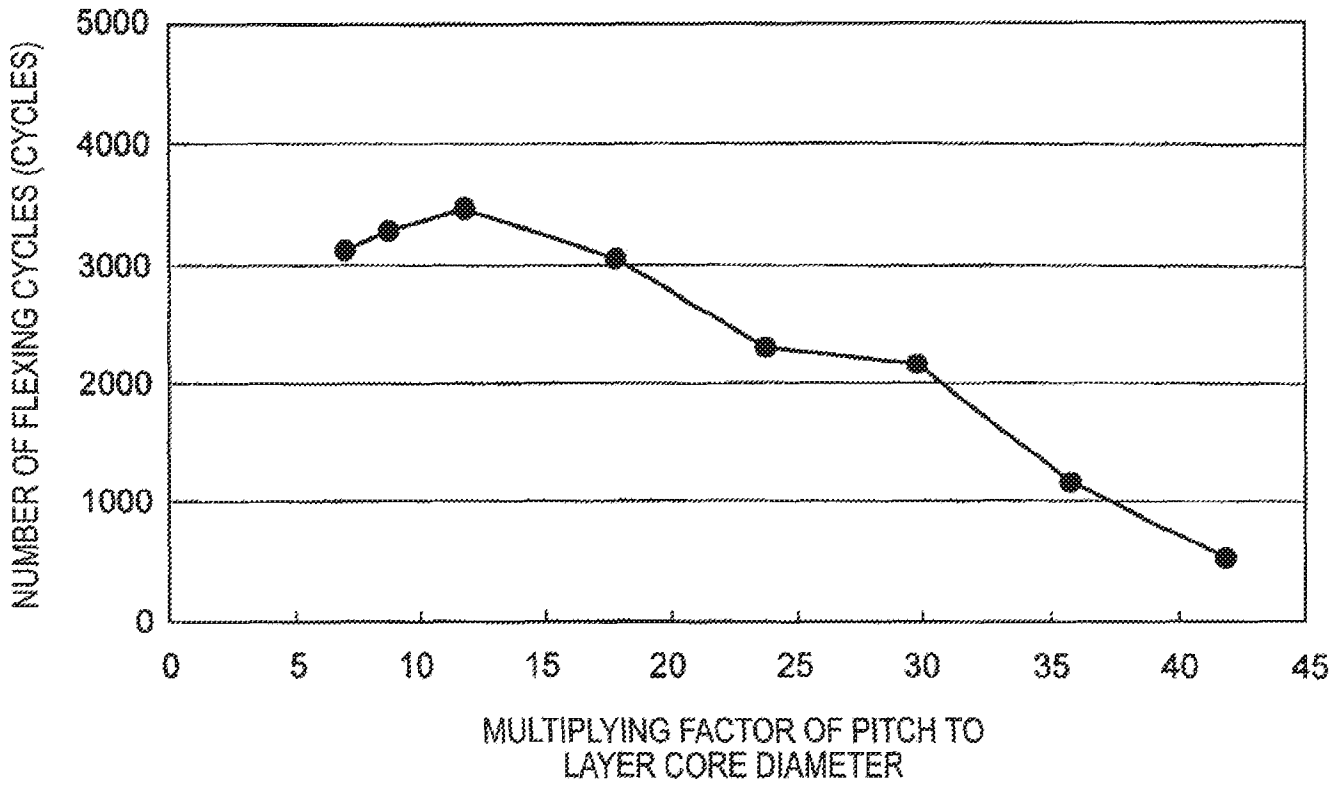
FIG. 8 is a graph for a multiplying factor of the pitch to the layer core diameter—the number of flexing cycles.

A table for the conductor outer diameter and the multiplying factor of the pitch-the number of flexing cycles is shown is shown in Table 3. A graph for the conductor outer diameter and the multiplying factor of the pitch-the number of flexing cycle is shown in FIG. 7. Further, a table for the multiplying factor of the pitch to the layer core diameter-the number of flexing cycles is shown in Table 4. A graph for the multiplying factor of the pitch to the layer core diameter-the number of flexing cycles is shown in FIG. 8.

TABLE 1

| | No. | Zr | Fe | Si wt % | Cu | Mg | Electric Conductivity % IACS | Tensile Strength MPa | Elongation % | Disconnection Property Good, Fair or Poor | Composition Judgment Good or Poor |
|---|---|---|---|---|---|---|---|---|---|---|---|
| Example | 1 | 0.02 | 0.1 | 0.02 | 0.06 | — | 60.6 | 81 | 28 | Good | Good |
| | 2 | 0.02 | 0.1 | 0.02 | — | 0.03 | 60.8 | 80 | 29 | Good | Good |
| | 3 | 0.08 | 0.1 | 0.02 | 0.06 | — | 58.2 | 82 | 24 | Good | Good |
| | 4 | 0.08 | 0.1 | 0.02 | — | 0.03 | 58.3 | 80 | 29 | Good | Good |
| | 5 | 0.02 | 0.9 | 0.02 | 0.06 | — | 59.4 | 121 | 17 | Good | Good |
| | 6 | 0.02 | 0.9 | 0.02 | — | 0.03 | 59.6 | 120 | 17 | Good | Good |
| | 7 | 0.02 | 0.1 | 2.3 | 0.06 | — | 58.5 | 195 | 11 | Good | Good |
| | 8 | 0.02 | 0.1 | 2.3 | — | 0.03 | 58.6 | 194 | 11 | Good | Good |
| | 9 | 0.02 | 0.1 | 0.02 | 0.45 | — | 58.3 | 112 | 15 | Good | Good |
| | 10 | 0.02 | 0.1 | 0.02 | — | 0.35 | 58.0 | 115 | 17 | Good | Good |
| | 11 | 0.05 | 0.6 | 0.02 | 0.12 | — | 58.3 | 111 | 18 | Good | Good |
| | 12 | 0.05 | 0.6 | 0.02 | — | 0.05 | 58.6 | 107 | 21 | Good | Good |
| | 13 | 0.03 | 0.8 | 0.02 | 0.2 | — | 58.3 | 127 | 16 | Good | Good |
| | 14 | 0.03 | 0.8 | 0.02 | — | 0.1 | 58.7 | 122 | 17 | Good | Good |
| | 15 | 0.02 | 0.1 | 0.02 | 0.05 | 0.04 | 60.4 | 85 | 23 | Good | Good |
| | 16 | 0.02 | 0.1 | 0.02 | 0.2 | 0.2 | 58.1 | 114 | 23 | Good | Good |
| | 17 | 0.08 | 0.1 | 0.02 | 0.05 | 0.03 | 58.0 | 84 | 23 | Good | Good |
| | 18 | 0.02 | 0.9 | 0.02 | 0.08 | 0.08 | 58.6 | 131 | 16 | Good | Good |
| | 19 | — | 0.1 | 0.02 | 0.05 | — | 61.5 | 80 | 24 | Good | Good |
| | 20 | — | 0.1 | 0.02 | 0.63 | — | 58.0 | 126 | 23 | Good | Good |
| | 21 | — | 0.1 | 0.02 | — | 0.04 | 61.5 | 80 | 18 | Good | Good |
| | 22 | — | 0.1 | 0.02 | — | 0.4 | 58.5 | 120 | 25 | Good | Good |
| | 23 | — | 0.1 | 0.02 | 0.55 | 0.05 | 58.1 | 126 | 20 | Good | Good |
| | 24 | — | 0.6 | 0.02 | 0.05 | — | 60.4 | 110 | 20 | Good | Good |
| | 25 | — | 0.6 | 0.02 | — | 0.04 | 60.4 | 110 | 19 | Good | Good |
| | 26 | — | 0.6 | 0.02 | — | 0.35 | 58.1 | 140 | 19 | Good | Good |
| | 27 | — | 0.9 | 0.02 | 0.05 | — | 60.3 | 120 | 22 | Good | Good |
| | 28 | — | 0.9 | 0.02 | — | 0.3 | 58.1 | 149 | 14 | Good | Good |
| | 29 | 0.02 | 0.9 | 0.02 | 0.08 | 0.08 | 58.6 | 131 | 16 | Good | Good |
| | 30 | 0.02 | 0.9 | 0.02 | 0.08 | 0.08 | 58.6 | 131 | 16 | Good | Good |
| | 31 | 0.02 | 0.9 | 0.02 | 0.08 | 0.08 | 58.6 | 131 | 16 | Good | Good |
| Comparative Example | 1 | 0.1 | 0.1 | 0.02 | 0.06 | 0 | 57.4 | 82 | 24 | Good | Poor |
| | 2 | 0.1 | 0.1 | 0.02 | 0 | 0.05 | 57.3 | 83 | 29 | Good | Poor |
| | 3 | 0.05 | 1.1 | 0.02 | 0.15 | 0 | 57.4 | 139 | 13 | Fair | Poor |
| | 4 | 0.05 | 1.2 | 0.02 | 0 | 0.1 | 57.3 | 143 | 11 | Fair | Poor |
| | 5 | 0.05 | 0.1 | 3 | 0.06 | 0 | 56.6 | 230 | 8 | Poor | Poor |
| | 6 | 0.05 | 0.1 | 3 | 0 | 0.03 | 56.7 | 229 | 9 | Poor | Poor |
| | 7 | 0.05 | 0.1 | 0.02 | 0.65 | 0 | 57.0 | 129 | 17 | Good | Poor |
| | 8 | 0.05 | 0.1 | 0.02 | 0 | 0.5 | 56.6 | 131 | 16 | Good | Poor |
| | 9 | 0.02 | 0.9 | 0.02 | 0.08 | 0.08 | 58.6 | 131 | 16 | Good | Good |
| | 10 | 0.02 | 0.9 | 0.02 | 0.08 | 0.08 | 58.6 | 131 | 16 | Good | Good |
| | 11 | 0.05 | 0.1 | 0.02 | — | 0.5 | 55.5 | 132 | 16 | Good | Poor |
| | 12 | 0.05 | 0.1 | 0.02 | — | 0.5 | 55.5 | 132 | 16 | Good | Poor |

TABLE 2

| | No. | Compact/ Non-Compact | Multiplying Factor of Twist Pitch times | Number of Flexing Cycles cycles | Number of Flexing Cycles Good or Poor | Overall Judgment Good or Poor |
|---|---|---|---|---|---|---|
| Example | 1 | Compact | 14 | 2835 | Good | Good |
| | 2 | Compact | 14 | 2384 | Good | Good |
| | 3 | Compact | 14 | 2954 | Good | Good |
| | 4 | Compact | 14 | 2241 | Good | Good |
| | 5 | Compact | 14 | 4823 | Good | Good |
| | 6 | Compact | 14 | 4923 | Good | Good |
| | 7 | Compact | 14 | 6294 | Good | Good |
| | 8 | Compact | 14 | 6183 | Good | Good |
| | 9 | Compact | 14 | 3922 | Good | Good |
| | 10 | Compact | 14 | 3623 | Good | Good |
| | 11 | Compact | 14 | 3463 | Good | Good |
| | 12 | Compact | 14 | 3642 | Good | Good |
| | 13 | Compact | 14 | 4624 | Good | Good |
| | 14 | Compact | 14 | 4426 | Good | Good |
| | 15 | Compact | 14 | 2734 | Good | Good |
| | 16 | Compact | 14 | 3563 | Good | Good |
| | 17 | Compact | 14 | 2354 | Good | Good |
| | 18 | Compact | 14 | 4351 | Good | Good |
| | 19 | Compact | 14 | 2253 | Good | Good |
| | 20 | Compact | 14 | 4322 | Good | Good |
| | 21 | Compact | 14 | 2134 | Good | Good |
| | 22 | Compact | 14 | 4223 | Good | Good |
| | 23 | Compact | 14 | 4562 | Good | Good |
| | 24 | Compact | 14 | 3243 | Good | Good |
| | 25 | Compact | 14 | 3125 | Good | Good |
| | 26 | Compact | 14 | 4523 | Good | Good |
| | 27 | Compact | 14 | 4255 | Good | Good |
| | 28 | Compact | 14 | 4324 | Good | Good |
| | 29 | Compact | 36 | 1356 | Good | Good |
| | 30 | Non-Compact | 12 | 3487 | Good | Good |
| | 31 | Non-Compact | 36 | 1142 | Good | Good |
| Comparative Example | 1 | Compact | 14 | 2734 | Good | Poor |
| | 2 | Compact | 14 | 2634 | Good | Poor |
| | 3 | Compact | 14 | 4163 | Good | Poor |
| | 4 | Compact | 14 | 4923 | Good | Poor |
| | 5 | Compact | 14 | 7284 | Good | Poor |
| | 6 | Compact | 14 | 7034 | Good | Poor |
| | 7 | Compact | 14 | 4228 | Good | Poor |
| | 8 | Compact | 14 | 4235 | Good | Poor |
| | 9 | Compact | 43 | 686 | Poor | Poor |
| | 10 | Non-Compact | 42 | 497 | Poor | Poor |
| | 11 | Compact | 43 | 523 | Poor | Poor |
| | 12 | Non-Compact | 42 | 364 | Poor | Poor |

TABLE 3

| Compact Conductor (Insulator Material: PP, 16 Wires Twisted) | | | | | | | |
|---|---|---|---|---|---|---|---|
| Flexing Test | Influence by Conductor Twist Pitch | | | | | | |
| Conductor Outer Diameter and Multiplying Factor of Pitch | 7 | 11 | 14 | 21 | 29 | 36 | 43 |
| Number of Flexing Cycles | 3839 | 4472 | 4351 | 3268 | 2729 | 1356 | 686 |

TABLE 4

| Non-Compact Conductor (Insulator Material: PP, 19 Wires Twisted) | | | | | | | | |
|---|---|---|---|---|---|---|---|---|
| Test Results | Influence by Conductor Twist Pitch | | | | | | | |
| Layer Core Diameter and Multiplying Factor of Pitch | 7 | 9 | 12 | 18 | 24 | 30 | 36 | 42 |
| Number of Flexing Cycles | 3127 | 3294 | 3487 | 3069 | 2321 | 2184 | 1142 | 497 |

Example 1

In Example 1, an aluminum alloy containing 0.02% by weight of Zr, 0.1% by weight of Fe, 0.02% by weight of Si and 0.06% by weight of Cu, with the remainder being Al and unavoidable impurities, is formed into aluminum alloy wires. By using the aluminum alloy having such a composition, an electric conductivity of 60.6% IACS, a tensile strength of 81 MPa and an elongation of 28% are obtained, the disconnection property becomes "good", and the composition judgment becomes "good". Further, in Example 1, a compact conductor is formed with a twist pitch of 14 times a diameter thereof. An electric wire formed using such a conductor has a number of flexing cycles of 2835, the judgment of the number of flexing cycles becomes "good", and the overall judgment becomes "good".

Example 2

In Example 2, an aluminum alloy containing 0.02% by weight of Zr, 0.1% by weight of Fe, 0.02% by weight of Si and 0.03% by weight of Mg, with the remainder being Al and unavoidable impurities, is formed into aluminum alloy wires. By using the aluminum alloy having such a composition, an electric conductivity of 60.8% IACS, a tensile strength of 80 MPa and an elongation of 29% are obtained, the disconnection property becomes "good", and the composition judgment becomes "good". Further, in Example 2, a compact conductor is formed with a twist pitch of 14 times a diameter thereof. An electric wire formed using such a conductor has a number of flexing cycles of 2384, the judgment of the number of flexing cycles becomes "good", and the overall judgment becomes "good".

Example 3

In Example 3, an aluminum alloy containing 0.08% by weight of Zr, 0.1% by weight of Fe, 0.02% by weight of Si and 0.06% by weight of Cu, with the remainder being Al and unavoidable impurities, is formed into aluminum alloy wires. By using the aluminum alloy having such a composition, an electric conductivity of 58.2% IACS, a tensile strength of 82 MPa and an elongation of 24% are obtained, the disconnection property becomes "good", and the composition judgment becomes "good". Further, in Example 3, a compact conductor is formed with a twist pitch of 14 times a diameter thereof. An electric wire formed using such a conductor has a number of flexing cycles of 2954, the judgment of the number of flexing cycles becomes "good", and the overall judgment becomes "good".

Example 4

In Example 4, an aluminum alloy containing 0.08% by weight of Zr, 0.1% by weight of Fe, 0.02% by weight of Si and 0.03% by weight of Mg, with the remainder being Al and unavoidable impurities, is formed into aluminum alloy wires. By using the aluminum alloy having such a composition, an electric conductivity of 58.3% IACS, a tensile strength of 80 MPa and an elongation of 29% are obtained, the disconnection property becomes "good", and the composition judgment becomes "good". Further, in Example 4, a compact conductor is formed with a twist pitch of 14 times a diameter thereof. An electric wire formed using such a conductor has a number of flexing cycles of 2241, the judgment of the number of flexing cycles becomes "good", and the overall judgment becomes "good".

Example 5

In Example 5, an aluminum alloy containing 0.02% by weight of Zr, 0.9% by weight of Fe, 0.02% by weight of Si and 0.06% by weight of Cu, with the remainder being Al and unavoidable impurities, is formed into aluminum alloy wires. By using the aluminum alloy having such a composition, an electric conductivity of 59.4% IACS, a tensile strength of 121 MPa and an elongation of 17% are obtained, the disconnection property becomes "good", and the composition judgment becomes "good". Further, in Example 5, a compact conductor is formed with a twist pitch of 14 times a diameter thereof. An electric wire formed using such a conductor has a number of flexing cycles of 4823, the judgment of the number of flexing cycles becomes "good", and the overall judgment becomes "good".

Example 6

In Example 6, an aluminum alloy containing 0.02% by weight of Zr, 0.9% by weight of Fe, 0.02% by weight of Si and 0.03% by weight of Mg, with the remainder being Al and unavoidable impurities, is formed into aluminum alloy wires. By using the aluminum alloy having such a composition, an electric conductivity of 59.6% IACS, a tensile strength of 120 MPa and an elongation of 17% are obtained, the disconnection property becomes "good", and the composition judgment becomes "good". Further, in Example 6, a compact conductor is formed with a twist pitch of 14 times a diameter thereof. An electric wire formed using such a conductor has a number of flexing cycles of 4923, the judgment of the number of flexing cycles becomes "good", and the overall judgment becomes "good".

Example 7

In Example 7, an aluminum alloy containing 0.02% by weight of Zr, 0.1% by weight of Fe, 2.3% by weight of Si and 0.06% by weight of Cu, with the remainder being Al and unavoidable impurities, is formed into aluminum alloy wires. By using the aluminum alloy having such a composition, an electric conductivity of 58.5% IACS, a tensile strength of 195 MPa and an elongation of 11% are obtained, the disconnection property becomes "good", and the composition judgment becomes "good". Further, in Example 7, a compact conductor is formed with a twist pitch of 14 times a diameter thereof. An electric wire formed using such a conductor has a number of flexing cycles of 6294, the judgment of the number of flexing cycles becomes "good", and the overall judgment becomes "good".

Example 8

In Example 8, an aluminum alloy containing 0.02% by weight of Zr, 0.1% by weight of Fe, 2.3% by weight of Si and 0.03% by weight of Mg, with the remainder being Al and unavoidable impurities, is formed into aluminum alloy wires. By using the aluminum alloy having such a composition, an electric conductivity of 58.6% IACS, a tensile strength of 194 MPa and an elongation of 11% are obtained, the disconnection property becomes "good", and the composition judgment becomes "good". Further, in Example 8, a compact conductor is formed with a twist pitch of 14 times a diameter thereof. An electric wire formed using such a conductor has a number of flexing cycles of 6183, the judgment of the number of flexing cycles becomes "good", and the overall judgment becomes "good".

Example 9

In Example 9, an aluminum alloy containing 0.02% by weight of Zr, 0.1% by weight of Fe, 0.02% by weight of Si and 0.45% by weight of Cu, with the remainder being Al and unavoidable impurities, is formed into aluminum alloy wires. By using the aluminum alloy having such a composition, an electric conductivity of 58.3% IACS, a tensile strength of 112 MPa and an elongation of 15% are obtained, the disconnection property becomes "good", and the composition judgment becomes "good". Further, in Example 9, a compact conductor is formed with a twist pitch of 14 times a diameter thereof. An electric wire formed using such a conductor has a number of flexing cycles of 3922, the judgment of the number of flexing cycles becomes "good", and the overall judgment becomes "good".

Example 10

In Example 10, an aluminum alloy containing 0.02% by weight of Zr, 0.1% by weight of Fe, 0.02% by weight of Si and 0.35% by weight of Mg, with the remainder being Al and unavoidable impurities, is formed into aluminum alloy wires. By using the aluminum alloy having such a composition, an electric conductivity of 58.0% IACS, a tensile strength of 115 MPa and an elongation of 17% are obtained, the disconnection property becomes "good", and the composition judgment becomes "good". Further, in Example 10, a compact conductor is formed with a twist pitch of 14 times a diameter thereof. An electric wire formed using such a conductor has a number of flexing cycles of 3623, the judgment of the number of flexing cycles becomes "good", and the overall judgment becomes "good".

Example 11

In Example 11, an aluminum alloy containing 0.05% by weight of Zr, 0.6% by weight of Fe, 0.02% by weight of Si and 0.12% by weight of Cu, with the remainder being Al and unavoidable impurities, is formed into aluminum alloy wires. By using the aluminum alloy having such a composition, an electric conductivity of 58.3% IACS, a tensile strength of 111 MPa and an elongation of 18% are obtained, the disconnection property becomes "good", and the composition judgment becomes "good". Further, in Example 11, a compact conductor is formed with a twist pitch of 14 times a diameter thereof. An electric wire formed using such a conductor has a number of flexing cycles of 3463, the judgment of the number of flexing cycles becomes "good", and the overall judgment becomes "good".

Example 12

In Example 12, an aluminum alloy containing 0.05% by weight of Zr, 0.6% by weight of Fe, 0.02% by weight of Si and 0.05% by weight of Mg, with the remainder being Al and unavoidable impurities, is formed into aluminum alloy wires. By using the aluminum alloy having such a composition, an electric conductivity of 58.6% IACS, a tensile strength of 107 MPa and an elongation of 21% are obtained, the disconnection property becomes "good", and the composition judgment becomes "good". Further, in Example 12, a compact conductor is formed with a twist pitch of 14 times a diameter thereof. An electric wire formed using such a conductor has a number of flexing cycles of 3642, the judgment of the number of flexing cycles becomes "good", and the overall judgment becomes "good".

Example 13

In Example 13, an aluminum alloy containing 0.03% by weight of Zr, 0.8% by weight of Fe, 0.02% by weight of Si and 0.2% by weight of Cu, with the remainder being Al and unavoidable impurities, is formed into aluminum alloy wires. By using the aluminum alloy having such a composition, an electric conductivity of 58.3% IACS, a tensile strength of 127 MPa and an elongation of 16% are obtained, the disconnection property becomes "good", and the composition judgment becomes "good". Further, in Example 13, a compact conductor is formed with a twist pitch of 14 times a diameter thereof. An electric wire formed using such a conductor has a number of flexing cycles of 4624, the judgment of the number of flexing cycles becomes "good", and the overall judgment becomes "good".

Example 14

In Example 14, an aluminum alloy containing 0.03% by weight of Zr, 0.8% by weight of Fe, 0.02% by weight of Si and 0.1% by weight of Mg, with the remainder being Al and unavoidable impurities, is formed into aluminum alloy wires. By using the aluminum alloy having such a composition, an electric conductivity of 58.7% IACS, a tensile strength of 122 MPa and an elongation of 17% are obtained, the disconnection property becomes "good", and the composition judgment becomes "good". Further, in Example 14, a compact conductor is formed with a twist pitch of 14 times a diameter thereof. An electric wire formed using such a conductor has a number of flexing cycles of 4426, the judgment of the number of flexing cycles becomes "good", and the overall judgment becomes "good".

Example 15

In Example 15, an aluminum alloy containing 0.02% by weight of Zr, 0.1% by weight of Fe, 0.02% by weight of Si, 0.05% by weight of Cu and 0.04% by weight of Mg, with the remainder being Al and unavoidable impurities, is formed into aluminum alloy wires. By using the aluminum alloy having such a composition, an electric conductivity of 60.4% IACS, a tensile strength of 85 MPa and an elongation of 23% are obtained, the disconnection property becomes "good", and the composition judgment becomes "good". Further, in Example 15, a compact conductor is formed with a twist pitch of 14 times a diameter thereof. An electric wire formed using such a conductor has a number of flexing cycles of 2734, the judgment of the number of flexing cycles becomes "good", and the overall judgment becomes "good".

Example 16

In Example 16, an aluminum alloy containing 0.02% by weight of Zr, 0.1% by weight of Fe, 0.02% by weight of Si, 0.2% by weight of Cu and 0.2% by weight of Mg, with the remainder being Al and unavoidable impurities, is formed into aluminum alloy wires. By using the aluminum alloy having such a composition, an electric conductivity of 58.1% IACS, a tensile strength of 114 MPa and an elongation of 23% are obtained, the disconnection property becomes "good", and the composition judgment becomes "good". Further, in Example 16, a compact conductor is formed with a twist pitch of 14 times a diameter thereof. An electric wire formed using such a conductor has a number of flexing cycles of 3563, the judgment of the number of flexing cycles becomes "good", and the overall judgment becomes "good".

Example 17

In Example 17, an aluminum alloy containing 0.08% by weight of Zr, 0.1% by weight of Fe, 0.02% by weight of Si, 0.05% by weight of Cu and 0.03% by weight of Mg, with the remainder being Al and unavoidable impurities, is formed into aluminum alloy wires. By using the aluminum alloy having such a composition, an electric conductivity of 58.0% IACS, a tensile strength of 84 MPa and an elongation of 23% are obtained, the disconnection property becomes "good", and the composition judgment becomes "good". Further, in Example 17, a compact conductor is formed with a twist pitch of 14 times a diameter thereof. An electric wire formed using such a conductor has a number of flexing cycles of 2354, the judgment of the number of flexing cycles becomes "good", and the overall judgment becomes "good".

Example 18

In Example 18, an aluminum alloy containing 0.02% by weight of Zr, 0.9% by weight of Fe, 0.02% by weight of Si, 0.08% by weight of Cu and 0.08% by weight of Mg, with the remainder being Al and unavoidable impurities, is formed into aluminum alloy wires. By using the aluminum alloy having such a composition, an electric conductivity of 58.6% IACS, a tensile strength of 131 MPa and an elongation of 16% are obtained, the disconnection property becomes "good", and the composition judgment becomes "good". Further, in Example 18, a compact conductor is formed with a twist pitch of 14 times a diameter thereof. An electric wire formed using such a conductor has a number of flexing cycles of 4351, the judgment of the number of flexing cycles becomes "good", and the overall judgment becomes "good".

Example 19

In Example 19, an aluminum alloy containing 0% by weight of Zr, 0.1% by weight of Fe, 0.02% by weight of Si and 0.05% by weight of Cu, with the remainder being Al and unavoidable impurities, is formed into aluminum alloy wires. By using the aluminum alloy having such a composition, an electric conductivity of 61.5% IACS, a tensile strength of 80 MPa and an elongation of 24% are obtained, the disconnection property becomes "good", and the composition judgment becomes "good". Further, in Example 19, a compact conductor is formed with a twist pitch of 14 times a diameter thereof. An electric wire formed using such a conductor has a number of flexing cycles of 2253, the judgment of the number of flexing cycles becomes "good", and the overall judgment becomes "good".

Example 20

In Example 20, an aluminum alloy containing 0% by weight of Zr, 0.1% by weight of Fe, 0.02% by weight of Si and 0.63% by weight of Cu, with the remainder being Al and unavoidable impurities, is formed into aluminum alloy wires. By using the aluminum alloy having such a composition, an electric conductivity of 58.0% IACS, a tensile strength of 126 MPa and an elongation of 23% are obtained, the disconnection property becomes "good", and the composition judgment becomes "good". Further, in Example 20, a compact conductor is formed with a twist pitch of 14 times a diameter thereof. An electric wire formed using such a conductor has a number of flexing cycles of 4322, the judgment of the number of flexing cycles becomes "good", and the overall judgment becomes "good".

Example 21

In Example 21, an aluminum alloy containing 0% by weight of Zr, 0.1% by weight of Fe, 0.02% by weight of Si and 0.04% by weight of Mg, with the remainder being Al and unavoidable impurities, is formed into aluminum alloy wires. By using the aluminum alloy having such a composition, an electric conductivity of 61.5% IACS, a tensile strength of 80 MPa and an elongation of 18% are obtained, the disconnection property becomes "good", and the composition judgment becomes "good". Further, in Example 21, a compact conductor is formed with a twist pitch of 14 times a diameter thereof. An electric wire formed using such a conductor has a number of flexing cycles of 2134, the judgment of the number of flexing cycles becomes "good", and the overall judgment becomes "good".

Example 22

In Example 22, an aluminum alloy containing 0% by weight of Zr, 0.1% by weight of Fe, 0.02% by weight of Si and 0.4% by weight of Mg, with the remainder being Al and unavoidable impurities, is formed into aluminum alloy wires. By using the aluminum alloy having such a composition, an electric conductivity of 58.5% IACS, a tensile strength of 120 MPa and an elongation of 25% are obtained, the disconnection property becomes "good", and the composition judgment becomes "good". Further, in Example 22, a compact conductor is formed with a twist pitch of 14 times a diameter thereof. An electric wire formed using such a conductor has a number of flexing cycles of 4223, the judgment of the number of flexing cycles becomes "good", and the overall judgment becomes "good".

Example 23

In Example 23, an aluminum alloy containing 0% by weight of Zr, 0.1% by weight of Fe, 0.02% by weight of Si, 0.55% by weight of Cu and 0.05% by weight of Mg, with the remainder being Al and unavoidable impurities, is formed into aluminum alloy wires. By using the aluminum alloy having such a composition, an electric conductivity of 58.1% IACS, a tensile strength of 126 MPa and an elongation of 20% are obtained, the disconnection property becomes "good", and the composition judgment becomes "good". Further, in Example 23, a compact conductor is formed with a twist pitch of 14 times a diameter thereof. An electric wire formed using such a conductor has a number of flexing cycles of 4562, the judgment of the number of flexing cycles becomes "good", and the overall judgment becomes "good".

Example 24

In Example 24, an aluminum alloy containing 0% by weight of Zr, 0.6% by weight of Fe, 0.02% by weight of Si and 0.05% by weight of Cu, with the remainder being Al and unavoidable impurities, is formed into aluminum alloy wires. By using the aluminum alloy having such a composition, an electric conductivity of 60.4% IACS, a tensile strength of 110 MPa and an elongation of 20% are obtained, the disconnection property becomes "good", and the composition judgment becomes "good". Further, in Example 24, a compact conductor is formed with a twist pitch of 14 times a diameter thereof. An electric wire formed using such a conductor has a number of flexing cycles of 3243, the judgment of the number of flexing cycles becomes "good", and the overall judgment becomes "good".

Example 25

In Example 25, an aluminum alloy containing 0% by weight of Zr, 0.6% by weight of Fe, 0.02% by weight of Si and 0.04% by weight of Mg, with the remainder being Al and unavoidable impurities, is formed into aluminum alloy wires. By using the aluminum alloy having such a composition, an electric conductivity of 60.4% IACS, a tensile strength of 110 MPa and an elongation of 19% are obtained, the disconnection property becomes "good", and the composition judgment becomes "good". Further, in Example 25, a compact conductor is formed with a twist pitch of 14 times a diameter thereof. An electric wire formed using such a conductor has a number of flexing cycles of 3125, the judgment of the number of flexing cycles becomes "good", and the overall judgment becomes "good".

Example 26

In Example 26, an aluminum alloy containing 0% by weight of Zr, 0.6% by weight of Fe, 0.02% by weight of Si and 0.35% by weight of Mg, with the remainder being Al and unavoidable impurities, is formed into aluminum alloy wires. By using the aluminum alloy having such a composition, an electric conductivity of 58.1% IACS, a tensile strength of 140 MPa and an elongation of 19% are obtained, the disconnection property becomes "good", and the composition judgment becomes "good". Further, in Example 26, a compact conductor is formed with a twist pitch of 14 times a diameter thereof. An electric wire formed using such a conductor has a number of flexing cycles of 4523, the judgment of the number of flexing cycles becomes "good", and the overall judgment becomes "good".

Example 27

In Example 27, an aluminum alloy containing 0% by weight of Zr, 0.9% by weight of Fe, 0.02% by weight of Si and 0.05% by weight of Cu, with the remainder being Al and unavoidable impurities, is formed into aluminum alloy wires. By using the aluminum alloy having such a composition, an electric conductivity of 60.3% IACS, a tensile strength of 120 MPa and an elongation of 22% are obtained, the disconnection property becomes "good", and the composition judgment becomes "good". Further, in Example 27, a compact conductor is formed with a twist pitch of 14 times a diameter thereof. An electric wire formed using such a conductor has a number of flexing cycles of 4255, the judgment of the number of flexing cycles becomes "good", and the overall judgment becomes "good".

Example 28

In Example 28, an aluminum alloy containing 0% by weight of Zr, 0.9% by weight of Fe, 0.02% by weight of Si and 0.3% by weight of Mg, with the remainder being Al and unavoidable impurities, is formed into aluminum alloy wires. By using the aluminum alloy having such a composition, an electric conductivity of 58.1% IACS, a tensile strength of 149 MPa and an elongation of 14% are obtained, the disconnection property becomes "good", and the composition judgment becomes "good". Further, in Example 28, a compact conductor is formed with a twist pitch of 14 times a diameter thereof. An electric wire formed using such a conductor has a number of flexing cycles of 4324, the judgment of the number of flexing cycles becomes "good", and the overall judgment becomes "good".

Example 29

In Example 29, an aluminum alloy containing 0.02% by weight of Zr, 0.9% by weight of Fe, 0.02% by weight of Si, 0.08% by weight of Cu and 0.08% by weight of Mg, with the remainder being Al and unavoidable impurities, is formed into aluminum alloy wires (the composition is the same as in Example 18). By using the aluminum alloy having such a composition, an electric conductivity of 58.6% IACS, a tensile strength of 131 MPa and an elongation of 16% are obtained, the disconnection property becomes "good", and the composition judgment becomes "good". Further, in Example 29, a compact conductor is formed with a twist pitch of 36 times a diameter thereof. An electric wire formed using such a conductor has a number of flexing cycles of 1356, the judgment of the number of flexing cycles becomes "good", and the overall judgment becomes "good".

Example 30

In Example 30, an aluminum alloy containing 0.02% by weight of Zr, 0.9% by weight of Fe, 0.02% by weight of Si, 0.08% by weight of Cu and 0.08% by weight of Mg, with the remainder being Al and unavoidable impurities, is formed into aluminum alloy wires (the composition is the same as in Example 18). By using the aluminum alloy having such a composition, an electric conductivity of 58.6% IACS, a tensile strength of 131 MPa and an elongation of 16% are obtained, the disconnection property becomes "good", and the composition judgment becomes "good". Further, in Example 26, a non-compact conductor is formed with a twist pitch of 12 times a diameter thereof. An electric wire formed using such a conductor has a number of flexing cycles of 3487, the judgment of the number of flexing cycles becomes "good", and the overall judgment becomes "good".

Example 31

In Example 31, an aluminum alloy containing 0.02% by weight of Zr, 0.9% by weight of Fe, 0.02% by weight of Si, 0.08% by weight of Cu and 0.08% by weight of Mg, with the remainder being Al and unavoidable impurities, is formed into aluminum alloy wires (the composition is the same as in Example 18). By using the aluminum alloy having such a composition, an electric conductivity of 58.6% IACS, a tensile strength of 131 MPa and an elongation of 16% are obtained, the disconnection property becomes "good", and the composition judgment becomes "good". Further, in Example 31, a non-compact conductor is formed with a twist pitch of 36 times a diameter thereof. An electric wire formed using such a conductor has a number of flexing cycles of 1142, the judgment of the number of flexing cycles becomes "good", and the overall judgment becomes "good".

Comparative Example 1

In Comparative Example 1, an aluminum alloy containing 0.1% by weight of Zr, 0.1% by weight of Fe, 0.02% by weight of Si and 0.06% by weight of Cu, with the remainder being Al and unavoidable impurities, is formed into aluminum alloy wires. By using the aluminum alloy having such a composition, an electric conductivity of 57.4% IACS, a tensile strength of 82 MPa and an elongation of 24% are obtained, and the disconnection property becomes "good". The composition judgment becomes "poor", because the electric conductivity is less than the standard. Further, in Comparative Example 1, a compact conductor is formed with a twist pitch of 14 times a diameter thereof. An electric wire formed using such a conductor has a number of flexing cycles of 2734, so that the judgment of the number of flexing cycles becomes "good". However, the overall judgment becomes "poor", because the composition judgment is "poor".

Comparative Example 2

In Comparative Example 2, an aluminum alloy containing 0.1% by weight of Zr, 0.1% by weight of Fe, 0.02% by weight of Si and 0.05% by weight of Mg, with the remainder being Al and unavoidable impurities, is formed into aluminum alloy wires. By using the aluminum alloy having such a composition, an electric conductivity of 57.3% IACS, a tensile strength of 83 MPa and an elongation of 29% are obtained, and the disconnection property becomes "good". The composition judgment becomes "poor", because the electric conductivity is less than the standard. Further, in Comparative Example 2, a compact conductor is formed with a twist pitch of 14 times a diameter thereof. An electric wire formed using such a conductor has a number of flexing cycles of 2634, so that the judgment of the number of flexing cycles becomes "good". However, the overall judgment becomes "poor", because the composition judgment is "poor".

Comparative Example 3

In Comparative Example 3, an aluminum alloy containing 0.05% by weight of Zr, 1.1% by weight of Fe, 0.02% by weight of Si and 0.15% by weight of Cu, with the remainder being Al and unavoidable impurities, is formed into aluminum alloy wires. By using the aluminum alloy having such a composition, an electric conductivity of 57.4% IACS, a tensile strength of 139 MPa and an elongation of 13% are obtained, and the disconnection property becomes "fair". The composition judgment becomes "poor", because the electric conductivity is less than the standard and the disconnection property is "fair". Further, in Comparative Example 3, a compact conductor is formed with a twist pitch of 14 times a diameter thereof. An electric wire formed using such a conductor has a number of flexing cycles of 4163, so that the judgment of the number of flexing cycles becomes "good". However, the overall judgment becomes "poor", because the composition judgment is "poor".

Comparative Example 4

In Comparative Example 4, an aluminum alloy containing 0.05% by weight of Zr, 1.2% by weight of Fe, 0.02% by weight of Si and 0.1% by weight of Mg, with the remainder being Al and unavoidable impurities, is formed into aluminum alloy wires. By using the aluminum alloy having such a composition, an electric conductivity of 57.3% IACS, a tensile strength of 143 MPa and an elongation of 11% are obtained, and the disconnection property becomes "fair". The composition judgment becomes "poor", because the electric conductivity is less than the standard and the disconnection property is "fair". Further, in Comparative Example 4, a compact conductor is formed with a twist pitch of 14 times a diameter thereof. An electric wire formed using such a conductor has a number of flexing cycles of 4923, do that the judgment of the number of flexing cycles becomes "good". However, the overall judgment becomes "poor", because the composition judgment is "poor".

Comparative Example 5

In Comparative Example 5, an aluminum alloy containing 0.05% by weight of Zr, 0.1% by weight of Fe, 3% by weight of Si and 0.06% by weight of Cu, with the remainder being Al and unavoidable impurities, is formed into aluminum alloy wires. By using the aluminum alloy having such a composition, an electric conductivity of 56.6% IACS, a tensile strength of 230 MPa and an elongation of 8% are obtained, and the disconnection property becomes "poor". The composition judgment becomes "poor", because the electric conductivity and the elongation are less than the standards and the disconnection property is "poor". Further, in Comparative Example 5, a compact conductor is formed with a twist pitch of 14 times a diameter thereof. An electric wire formed using such a conductor has a number of flexing cycles of 7284, so that the judgment of the number of flexing cycles becomes "good". However, the overall judgment becomes "poor", because the composition judgment is "poor".

Comparative Example 6

In Comparative Example 6, an aluminum alloy containing 0.05% by weight of Zr, 0.1% by weight of Fe, 3% by weight of Si and 0.03% by weight of Mg, with the remainder being Al and unavoidable impurities, is formed into aluminum alloy wires. By using the aluminum alloy having such a composition, an electric conductivity of 56.7% IACS, a tensile strength of 229 MPa and an elongation of 9% are obtained, and the disconnection property becomes "poor". The composition judgment becomes "poor", because the electric conductivity and the elongation are less than the standards and the disconnection property is "poor". Further, in Comparative Example 6, a compact conductor is formed with a twist pitch of 14 times a diameter thereof. An electric wire formed using such a conductor has a number of flexing cycles of 7034, so that the judgment of the number of flexing cycles becomes "good". However, the overall judgment becomes "poor", because the composition judgment is "poor".

Comparative Example 7

In Comparative Example 7, an aluminum alloy containing 0.05% by weight of Zr, 0.1% by weight of Fe, 0.02% by weight of Si and 0.65% by weight of Cu, with the remainder being Al and unavoidable impurities, is formed into aluminum alloy wires. By using the aluminum alloy having such a composition, an electric conductivity of 57.0% IACS, a tensile strength of 129 MPa and an elongation of 17% are obtained, and the disconnection property becomes "good". The composition judgment becomes "poor", because the electric conductivity is less than the standard. Further, in Comparative Example 7, a compact conductor is formed with a twist pitch of 14 times a diameter thereof. An electric wire formed using such a conductor has a number of flexing cycles of 4228, so that the judgment of the number of flexing cycles becomes "good". However, the overall judgment becomes "poor", because the composition judgment is "poor".

Comparative Example 8

In Comparative Example 8, an aluminum alloy containing 0.05% by weight of Zr, 0.1% by weight of Fe, 0.02% by weight of Si and 0.5% by weight of Mg, with the remainder being Al and unavoidable impurities, is formed into aluminum alloy wires. By using the aluminum alloy having such a composition, an electric conductivity of 56.6% IACS, a tensile strength of 131 MPa and an elongation of 16% are obtained, and the disconnection property becomes "good". The composition judgment becomes "poor", because the electric conductivity is less than the standard. Further, in Comparative Example 8, a compact conductor is formed with a twist pitch of 14 times a diameter thereof. An electric wire formed using such a conductor has a number of flexing cycles of 4235, so that the judgment of the number of flexing cycles becomes "good". However, the overall judgment becomes "poor", because the composition judgment is "poor".

Comparative Example 9

In Comparative Example 9, an aluminum alloy containing 0.02% by weight of Zr, 0.9% by weight of Fe, 0.02% by weight of Si, 0.08% by weight of Cu and 0.08% by weight of Mg, with the remainder being Al and unavoidable impurities, is formed into aluminum alloy wires (the composition is the same as in Example 18). By using the aluminum alloy having such a composition, an electric conductivity of 58.6% IACS, a tensile strength of 131 MPa and an elongation of 16% are obtained and the disconnection property becomes "good", so that the composition judgment becomes "good". Further, in Comparative Example 9, a compact conductor is formed with a twist pitch of 43 times a diameter thereof. An electric wire formed using such a conductor has a number of flexing cycles of 686, so that the judgment of the number of flexing cycles becomes "poor". The overall judgment becomes "poor", because the judgment of the number of flexing cycles is "poor".

Comparative Example 10

In Comparative Example 10, an aluminum alloy containing 0.02% by weight of Zr, 0.9% by weight of Fe, 0.02% by weight of Si, 0.08% by weight of Cu and 0.08% by weight of Mg, with the remainder being Al and unavoidable impurities, is formed into aluminum alloy wires (the composition is the same as in Example 18). By using the aluminum alloy having such a composition, an electric conductivity of 58.6% IACS, a tensile strength of 131 MPa and an elongation of 16% are obtained, and the disconnection property becomes "good", so that the composition judgment becomes "good". Further, in Comparative Example 10, a non-compact conductor is formed with a twist pitch of 42 times a diameter thereof. An electric wire formed using such a conductor has a number of flexing cycles of 497, so that the judgment of the number of flexing cycles becomes "poor".

The overall judgment becomes "poor", because the judgment of the number of flexing cycles is "poor".

Comparative Example 11

In Comparative Example 11, an aluminum alloy containing 0.05% by weight of Zr, 0.1% by weight of Fe, 0.02% by weight of Si and 0.5% by weight of Mg, with the remainder being Al and unavoidable impurities, is formed into aluminum alloy wires. By using the aluminum alloy having such a composition, an electric conductivity of 55.5% IACS, a tensile strength of 132 MPa and an elongation of 16% are obtained, and the disconnection property becomes "good". The composition judgment becomes "poor", because the electric conductivity is less than the standard. Further, in Comparative Example 11, a compact conductor is formed with a twist pitch of 43 times a diameter thereof. An electric wire formed using such a conductor has a number of flexing cycles of 523, so that the judgment of the number of flexing cycles becomes "poor". The overall judgment becomes "poor", because the judgment of the number of flexing cycles is "poor".

Comparative Example 12

In Comparative Example 12, an aluminum alloy containing 0.05% by weight of Zr, 0.1% by weight of Fe, 0.02% by weight of Si and 0.5% by weight of Mg, with the remainder being Al and unavoidable impurities, is formed into aluminum alloy wires (the composition is the same as in Comparative Example 11). By using the aluminum alloy having such a composition, an electric conductivity of 55.5% IACS, a tensile strength of 132 MPa and an elongation of 16% are obtained, and the disconnection property becomes "good". The composition judgment becomes "poor", because the electric conductivity is less than the standard. Further, in Comparative Example 12, a non-compact conductor is formed with a twist pitch of 42 times a diameter thereof. An electric wire formed using such a conductor has a number of flexing cycles of 364, so that the judgment of the number of flexing cycles becomes "poor". The overall judgment becomes "poor", because the judgment of the number of flexing cycles is "poor".

Comparative Example 1, Example 1 and Example 3

In Comparative Example 1, the Zr content deviates from the range of the invention, compared to that in Example 1 and Example 3. Consequently, the electric conductivity is less than the standard, so that the composition judgment becomes "poor". Accordingly, the overall judgment becomes "poor".

Comparative Example 2, Example 2 and Example 4

In Comparative Example 2, the Zr content deviates from the range of the invention, compared to that in Example 2 and Example 4. Consequently, the electric conductivity is less than the standard, so that the composition judgment becomes "poor". Accordingly, the overall judgment becomes "poor".

Comparative Example 3 and Example 11

In Comparative Example 3, the Fe content deviates from the range of the invention, compared to that in Example 11. Consequently, the electric conductivity is less than the standard, and the disconnection property becomes "fair". As a result, the composition judgment becomes "poor". Accordingly, the overall judgment becomes "poor".

Comparative Example 4 and Example 12

In Comparative Example 4, the Fe content deviates from the range of the invention, compared to that in Example 12. Consequently, the electric conductivity is less than the standard, and the disconnection property becomes "fair". As a result, the composition judgment becomes "poor". Accordingly, the overall judgment becomes "poor".

Comparative Example 5, Example 1 and Example 7

In Comparative Example 5, the Si content deviates from the range of the invention, compared to that in Example 1 and Example 7. Consequently, the electric conductivity and the elongation are less than the standards, and the disconnection property becomes "poor". As a result, the composition judgment becomes "poor". Accordingly, the overall judgment becomes "poor".

Comparative Example 6, Example 2 and Example 8

In Comparative Example 6, the Si content deviates from the range of the invention, compared to that in Example 2 and Example 8. Consequently, the electric conductivity and the elongation are less than the standards, and the disconnection property becomes "poor". As a result, the composition judgment becomes "poor". Accordingly, the overall judgment becomes "poor".

Comparative Example 7, Example 1, Example 9 and Example 13

In Comparative Example 7, the Cu content deviates from the range of the invention, compared to that in Example 1, Example 9 and Example 13. Consequently, the electric conductivity is less than the standard, so that the composition judgment becomes "poor". Accordingly, the overall judgment becomes "poor".

Comparative Example 8, Example 2, Example 10 and Example 14

In Comparative Example 8, the Mg content deviates from the range of the invention, compared to that in Example 2, Example 10 and Example 14. Consequently, the electric conductivity is less than the standard, so that the composition judgment becomes "poor". Accordingly, the overall judgment becomes "poor".

Comparative Example 9, Example 18 and Example 29

In Comparative Example 9, the multiplying factor of the twist pitch deviates from the range of the invention, compared to that in Example 18 and Example 29. Consequently, the number of flexing cycles is less than the standard, so that the judgment of the number of flexing cycles becomes "poor". Accordingly, the overall judgment becomes "poor".

Comparative Example 10, Example 30 and Example 31

In Comparative Example 10, the multiplying factor of the twist pitch deviates from the range of the invention, compared to that in Example 30 and Example 31. Consequently, the number of flexing cycles is less than the standard, so that the judgment of the number of flexing cycles becomes "poor". Accordingly, the overall judgment becomes "poor".

Comparative Example 11, Comparative Example 12 and Example 2

In Comparative Examples 11 and 12, the Mg content deviates from the range of the invention, compared to that in Example 2. Consequently, the electric conductivity is less than the standard, so that the composition judgment becomes "poor". Further, in Comparative Examples 11 and 12, the multiplying factor of the twist pitch deviates from the range of the invention, compared to that in Example 2. Consequently, the number of flexing cycles is less than the standard, so that the judgment of the number of flexing cycles becomes "poor". Accordingly, the overall judgment becomes "poor".

Incidentally, comparison of Examples with each other results in revealing an increase and decrease in electric conductivity, tensile strength and elongation.

The features of the invention described above are summarized as follows: (1) The electric wire or cable includes the conductor obtained by twisting together the aluminum alloy wires; (2) The conductor is formed with a conductor twist pitch of 7 to 36 times a predetermined diameter thereof; (3) As the composition of the aluminum alloy before formation of the aluminum alloy wires, Fe is contained in an amount of 0.1 to less than 1.0% by weight; (4) Further, Zr is contained in an amount of 0 to 0.08% by weight; (5) Furthermore, Si is contained in an amount of 0.02 to 2.8% by weight; (6) In addition, at least one of Cu and Mg is contained; (7) Cu is contained in an amount of 0.05 to 0.63% by weight; (8) Mg is contained in an amount of 0.03 to 0.45% by weight; and (9) The remainder is Al and unavoidable impurities.

With respect to the above conductor twist pitch, Table 3 and Table 4 shows that it is effective that the multiplying factor is from 7 to 36 times. In the invention, the electric wire or cable having a large number of flexing cycles, namely having high flexibility, is of course obtained by adjusting the multiplying factor to 10 to 30 times, adding an allowance to such a multiplying factor.

In the invention, various modifications are of course possible within the range not departing from the gist of the invention.

INDUSTRIAL APPLICABILITY

According to the invention, it is possible to provide an electric wire or cable whose flexibility can be enhanced.

REFERENCE SIGNS LIST

1: Electric wire
2: Conductor
3: Insulator
4: Aluminum alloy wires
D: Layer core diameter (predetermined diameter)
D': Conductor outer diameter (predetermined diameter)
P: Conductor twist pitch

What is claimed is:

1. A method for manufacturing an electric wire comprising a conductor, the method comprising:

providing wire rods made of aluminum alloy, a composition of the aluminum alloy containing a predetermined amount of Al, 0.1 to less than 1.0% by weight of Fe, 0 to 0.08% by weight of Zr, 0.02 to 2.8% by weight of Si, and at least one of Cu and Mg, where the amount of Cu is 0.05 to 0.63% by weight and the amount of Mg is 0.03 to 0.45% by weight;

forming aluminum alloy wires by drawing, without heat treatment, the wire rods to a final wire diameter; and forming the conductor by twisting the aluminum alloy wires together with a twist pitch of 7 to 36 times a predetermined diameter of the conductor, wherein the aluminum alloy wires have an elongation of 10% or more after forming the aluminum alloy wires.

2. The method according to claim 1, wherein the final wire diameter is 0.32 mm.

3. The method according to claim 1, wherein the aluminum alloy wires have a tensile strength of 80 MPa or more, after forming the aluminum alloy wires.

4. A method for manufacturing an electric wire comprising a conductor, the method comprising:

providing wire rods made of aluminum alloy, a composition of the aluminum alloy containing a predetermined amount of Al, 0.1 to less than 1.0% by weight of Fe, 0 to 0.08% by weight of Zr, 0.02 to 2.8% by weight of Si, and at least one of Cu and Mg, where the amount of Cu is 0.05 to 0.63% by weight and the amount of Mg is 0.03 to 0.45% by weight;

forming aluminum alloy wires by drawing, without heat treatment, the wire rods to a final wire diameter; and forming the conductor by twisting the aluminum alloy wires together with a twist pitch of 10 to 30 times a predetermined diameter of the conductor.

5. The method according to claim 1, wherein the composition of the aluminum alloy contains 0.02 to 0.08% by weight of Zr.

6. The method according to claim 1, wherein the composition of the aluminum alloy contains 0.04 to 0.6% by weight of Cu and Mg.

7. The method according to claim 6, wherein the composition of the aluminum alloy contains 0.1 to 0.4% by weight of Cu and Mg.

8. The method according to claim 3, wherein the aluminum alloy wires have an electric conductivity of 57.5% IACS or more.

9. The method according to claim 1, further comprising annealing the drawn wire rods after the drawing of the wire rods to the final wire diameter.

10. The method according to claim 2, wherein the wire rods are drawn, without heat treatment, from a diameter of 9.5 mm to the final wire diameter by having said composition of the aluminum alloy.

11. The method according to claim 4, wherein the final wire diameter is 0.32 mm.

12. The method according to claim 11, wherein the wire rods are drawn, without heat treatment, from a diameter of 9.5 mm to the final wire diameter by having said composition of the aluminum alloy.

* * * * *